US006558098B1

(12) United States Patent
Angehrn et al.

(10) Patent No.: US 6,558,098 B1
(45) Date of Patent: May 6, 2003

(54) FIXING ELEMENT AND METHOD FOR FIXING INSULATION TRACKS OR PLATES ON A FIXED SUBSTRUCTURE

(75) Inventors: Beda Angehrn, Au (CH); Daniel Gasser, Diepoldsau (CH); Norbert Köppel, Au (CH); Helmut Öesterle, Feldkirch (AT); Werner Patsch, Vaduz (LI)

(73) Assignee: SFS Industrie Holding AG, Heerbrugg (SE)

( * ) Notice: Subject to any disclaimer, the term of this patent is extended or adjusted under 35 U.S.C. 154(b) by 0 days.

(21) Appl. No.: 09/806,958

(22) PCT Filed: Oct. 4, 1999

(86) PCT No.: PCT/EP99/07341

§ 371 (c)(1),
(2), (4) Date: Apr. 6, 2001

(87) PCT Pub. No.: WO00/20703

PCT Pub. Date: Apr. 13, 2000

(30) Foreign Application Priority Data

Oct. 7, 1998 (DE) ..... 198 46 204

(51) Int. Cl.[7] ..... F16B 35/02; F16B 43/00

(52) U.S. Cl. ..... 411/533; 411/371.2; 411/383; 411/531

(58) Field of Search ..... 411/383, 384, 411/531, 533, 368, 371.2

(56) References Cited

U.S. PATENT DOCUMENTS

| | | | | |
|---|---|---|---|---|
| 5,122,022 A | | 6/1992 | Kluser | |
| 5,217,339 A | * | 6/1993 | O'Connor et al. | 411/533 X |
| 5,265,998 A | * | 11/1993 | Kluser | 411/384 X |
| 6,308,483 B1 | * | 10/2001 | Romine | 411/533 X |

FOREIGN PATENT DOCUMENTS

| | | |
|---|---|---|
| DE | 3515734 | 11/1986 |
| DE | 9100658 | 5/1991 |
| DE | 29618959 | 2/1997 |
| DE | 19544682 | 6/1997 |
| DE | 19735276 | 2/1999 |
| EP | 0288023 | 10/1988 |
| WO | 8902504 | 3/1989 |

* cited by examiner

*Primary Examiner*—Neill Wilson
(74) *Attorney, Agent, or Firm*—Volpe and Koenig PC

(57) ABSTRACT

The invention relates to a fixing element (1) for fixing insulation and scaling tracks on a fixed substructure. Said element comprises a screw (9) and a large washer (7) with a cylindrical extension (8). The screw (9) has two thread segments (13, 14), wherein one thread segment (13) interacts with the through hole in a reciprocal thread engagement located in a narrowed area (12) of the cylindrical extension (8). An axial relative movement of both parts can be achieved by reciprocally rotating the cylindrical extension (8) and the screw (9).

12 Claims, 3 Drawing Sheets

FIXING ELEMENT AND METHOD FOR FIXING INSULATION TRACKS OR PLATES ON A FIXED SUBSTRUCTURE

BACKGROUND OF THE INVENTION

The invention relates to a fastening element for attaching insulating strips or plates and possibly additional sealing strips to a solid substructure, consisting of a screw which is provided with a thread over at least a portion of the length of its shaft and has a screw head, and a large-area washer having a tubular extension, in which the extension of the washer has, at least over a large portion of its length, an internal cross-section sufficiently large for the rotatable reception and for the axial displacement of the screw head and which is narrowed at its end region remote from the washer to permit passage of the screw's shaft. The invention relates further to a method of attaching insulating strips or plates and possibly other additional sealing strips or bituminous underlayers to a solid substructure of thin concrete by means of a fastening element which consists of a screw and a large-area washer having a tubular extension.

DESCRIPTION OF THE RELATED ART

Solutions are indeed known, in which the fastener is telescopically slidable within the tubular extension, so that a variation in overall length can be achieved. However, such a construction is not desirable, especially for a roof structure in which the large-area washer is to be pressed against the top-most sealing strip.

Applications for attaching insulating and sealing strips to a substructure of thin concrete or other materials, e.g. sheet metal and the like, also exist in new construction, when a relatively thick insulating strip is used. In such a case, too, the overall length of the fastening element formed by the fastener itself and the tubular extension of the large-area washer, desirably enables the compensation for different overall thicknesses of the materials to be attached, over a relatively wide range. Especially for cases in which such compensation is desired, but the known telescope-like configuration of relatively slidable fastener and tubular extension is not suitable, there were heretofore no adequate solutions.

BRIEF SUMMARY OF THE INVENTION

Therefore, the object of the present invention is to provide a fastening element and a method of the kind described at the outset, by which large attachment distances can be bridged by the use of a fastener and a large-area washer with a tubular extension, which nevertheless enables the adequately forceful pressing of the large-area washer against the topmost sealing or insulating strip.

This is accomplished in accordance with the invention by making the outer diameter of the screw shaft thread greater than the free pass-through opening of the narrowed region of the tubular extension, whereby the screw is in operative engagement with the narrowed region of the tubular extension through mutual threaded engagement, or else can be brought into such engagement by rotating the screw into the pass-through opening.

By these techniques embodying the invention, the washer with its tubular extension can be pushed into a correspondingly preformed hole in the entire structure, using a washer with a tubular extension of the available length. During screwing of the fastener into the substructure, the same simultaneously enters into operative engagement with the tubular extension over an appropriate thread section, so that telescope-like axial displacement between fastener and tubular extension is no longer possible. Thus the fastener and the washer with its tubular extension form an axially stable attaching element. However, because the fastener and the narrowed region of the tubular extension are in mutual threaded engagement, the washer together with its tubular extension can subsequently still be rotated—if that appears to be necessary—whereby, for example, the force pressing the large-area washer against the top side of the insulating or sealing strip can be increased. That is, through rotation of the large-area washer, the latter is drawn axially further toward the interior, depending upon the thread pitch of the fastener, or else the applied pressure can be reduced by reverse rotation of the washer and with it the tubular extension, if the compressing is too strong.

An advantageous embodiment provides that the screw is provided with a thread over at least a substantial portion of the length of its shaft. By so doing, a large region can be used as the needed overall length of the attaching element, because the fastener can extend more or less far into the tubular extension of the washer. What is important is only that a threaded region of the fastener is in threaded engagement with the narrowed region at the free end of the tubular extension. For that reason, for greatest possible utilization of the length of the fastener and of the length of the tubular extension, it is desirable that the screw be provided with a thread over the entire length of the shaft.

A further advantageous construction consists in providing two differently formed thread sections on the shaft of the screw. This permits accommodating the possibility that, in the substructure to which the entire structure is to be ultimately attached, there can be provided a thread which is suitable for the substructure and the optimum thread configuration can be provided in the region of threaded engagement between the screw and the narrowed portion of the tubular extension.

In this regard, it is preferred that the two thread sections on the screw shaft have different diameters but the same thread pitch. To achieve even better engagement, it may be appropriate to penetrate the substructure using a smaller outer diameter. This also makes it possible, for example, that the first thread section of smaller diameter does not need to be threaded through the narrowed portion of the tubular extension. This is desirable especially for pre-mounting the fastener in the tubular extension.

For special substructures, it may be desirable to make the smaller diameter thread section at the free end of the screw shaft double-threaded. This also makes it possible to make the double-threaded part of the threaded section with threads having different outer diameters. Such a structural configuration is especially advantageous for direct application to concrete.

A further desirable embodiment provides that, if there are two thread sections of different diameters, the pass-through opening of the narrowed region of the tubular extension approximately equals the outer diameter of that section of the shaft having the smaller diameter thread. This enables initial centering of the free end of the fastener in the narrowed region during pre-mounting, after which an inseparable pre-mounting becomes possible by means of one or more rotations.

In the tubular extension, the narrowed region of the pass-through opening can be simply cylindrical. By so doing, as a practical matter, a thread is cut or pressed into a corresponding core-boring of the inserted fastener. In principle, an appropriate thread-boring can also be made in advance in the region of the pass-through opening, although this involves substantially higher manufacturing costs for the tubular extension.

The pass-through opening in the narrowed region of the tubular extension can also be non-round in cross-section, or else provided on its wall with ribs, protrusions, burls, grooves, or the like. In that version, there sometimes exists no circumferentially closed mutual thread engagement, but that is also not necessary for certain applications. What must be assured is only that mutual axial displacement between fastener and tubular extension results from mutual relative rotation with an advance corresponding to the thread engagement.

In the inventive method, it is proposed to first make, in the structure formed by insulating strips, or plates, sealing strips and possibly additional layers, a hole substantially equal to the outer diameter of the tubular extension, then to make a hole in the concrete substructure which matches the thread of the screw, or of a hole in a plug for screw insertion. There the washer with its tubular extension and the screw are inserted and the screw is driven in to the expected penetration depth. In so doing, the screw forms a mating thread in the narrowed end region of the extension, or engages a thread previously formed therein. Finally, if stronger pressure of the washer against the top-most insulating strip is needed, the washer together with its tubular extension, which is in cooperative engagement with the screw, is rotated relative to the screw.

By this process, optimum fastening is obtained not only in restorations of existing roofing structures, but also in new construction. But especially in the renovation of a substructure whose thickness is not known in advance, the above-described fastening element used with the inventive process is especially desirable. Even the making of the first hole in the overall structure can already provide a kind of test hole, by means of which the overall thickness of the structure can be determined. Then, fastening elements can be used in which the length of the tubular extension and the length of the screw are coordinated. Also optimized is the ability to retroactively, i.e. after final setting of the fastener, to adjust the pressure of the washer by rotating it relative to the fastener.

A further desirable feature of the method is that the uppermost edge of the opening, which is defined in the washer by its tubular extension, can be brought into cooperative relationship by means of a drive tool. Required is only appropriate friction between the tool and the washer, in order to effect a rotation thereof, and with it a drawing-together, or a loosening.

BRIEF DESCRIPTION OF THE SEVERAL VIEWS OF THE DRAWINGS

Additional inventive features and special advantages are explained in more detail in the description which follows. There is shown by.

DETAILED DESCRIPTION OF THE INVENTION

Figure 1:
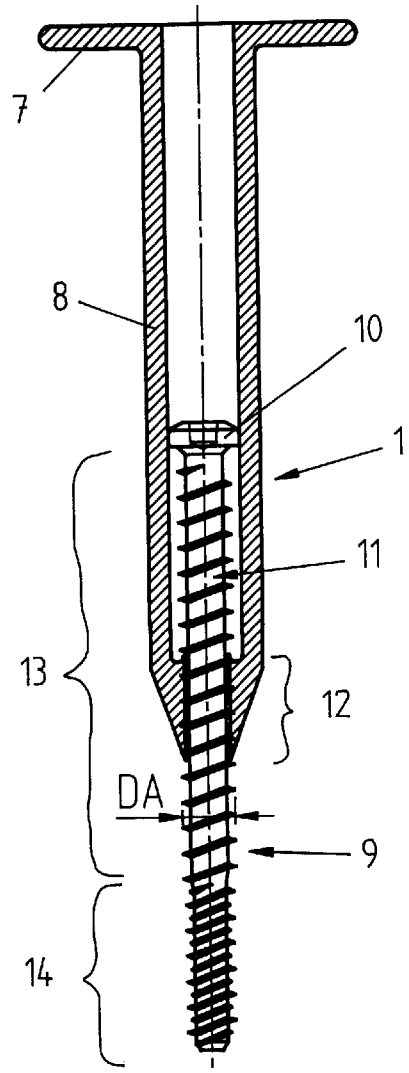
FIG. 1, a fastening element according to the invention, which shows in cross-section the large-area washer with its tubular extension.
Figure 2:
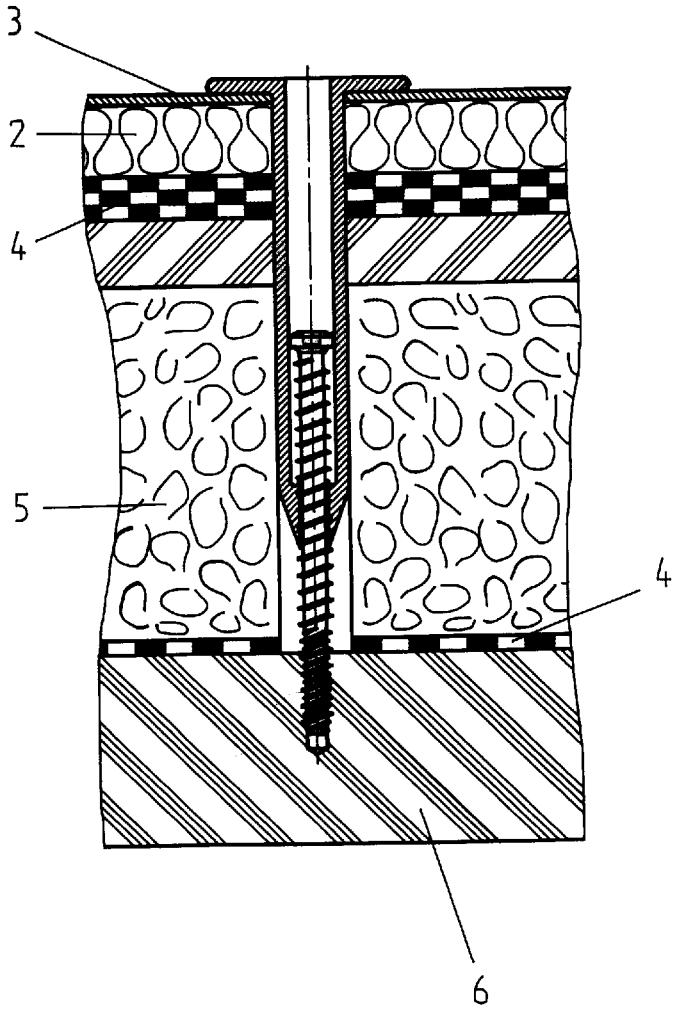
FIG. 2, a section through a roofing structure with applied fastening element.

The fastening element 1 serves to attach to a fixed substructure 6 insulating strips 2 and possibly additional sealing strips 3 or, for example, additional bituminous underlayers 4 or other substructure materials 5. In the example shown, the fixed substructure 6 to which the whole addition is to be ultimately attached, takes the form of a thin walled concrete element.

The fastening element 1 consists of a large-area washer 7 having a tubular extension 8 and a screw 9. Screw 9 is provided with a screw head 10 and a shaft 11 which is provided with a thread over at least a portion of its length.

The tubular extension 8 has, at least over a large section of its length, a central recess, with an internal cross-section sufficient for rotational reception and axial displacement of screw head 10. At the end remote from washer 7, a narrowed portion 12 is provided, but which permits passage of the shaft 11 of screw 9. However, shaft 11 can not pass slideably through the narrowed region 12 in the axial direction because the outer diameter DA of shaft 11 provided with the thread is larger than the free pass-through opening of narrowed region 12. This makes it possible for a mutual threaded engagement to exist between screw 9 and the inner wall of the pass-through opening in the narrowed region of the tubular extension.

Screw 9 has a thread over at least a major portion of the length of its shaft. In order to achieve greater displacement opportunity between the screw and the tubular extension 8, this thread preferably extends over the entire length of shaft 11.

In the illustrated embodiment of the fastening element, there are provided on shaft 11 of screw 9 two differently configured thread sections 13 and 14. These two thread sections 13 and 14 preferably have different diameters, but the same thread pitch. This precludes relative motion between screw 9 and tubular extension 8 during the initial setting of the screw 9, i.e. during turning of screw 9 into the substructure 6. The tubular extension 8, and with it also the large-area washer 7, remain in their initial positions until the final setting of screw 9. However, thereafter, additional drawing and pressing together of washer 7 is possible by rotating it together with its tubular extension.

A match to the materials into which they are to be driven, can be achieved by special configuration of the thread segments. Thus, in the proposed example, the thread section 14 with the smaller diameter at the free end of shaft 11 should take the form of a double thread, in which the two thread sections have different outer diameters.

In the proposed embodiment, the two thread sections 13 and 14 with different diameters are so conformed to the pass-through opening in the narrowed region 12 of the tubular extension 8 that the outer diameter of the section of shaft 11 having the smaller diameter thread is approximately equal to the cross-section of the pass-through opening in the narrowed section 12. In this way, during pre-mounting of screw 9 in tubular extension 8, the first thread section 14 can simply be pushed through the narrowed region 12, so that only the thread section 13 engages the wall of the pass-through opening in narrowed region 12.

The pass-through opening in narrowed region 12 of the tubular extension 8 is preferably cylindrical, the thread being formed by the driven-in screw or else in advance during manufacture of tubular extension 8. For the narrowed region 12 of the pass-through opening various configurations are also possible. Thus, the cross-section can be made other than round, or there can be provided in the region of the wall of the pass-through opening ribs, protrusions, burls, grooves, or the like. To prevent relative axial sliding, mutual engagement with the tubular extension should take place by the thread of screw 9 or by a thread section 13 of screw 9. Axial displacement is to be possible only by rotating the tubular extension relative to screw 9.

With reference to FIGS. 3–8, there will now be explained the inventive method for attaching insulating strips 2 and additional sealing strips 3 to a fixed substructure 6 made of a thin concrete plate. In so doing, it will be assumed that the screw 9 with its thread section 14 formed at its free end directly engages the substructure 6. It is also possible to provide in the substructure a hole for a plug into which a screw is caused to engage.

Figure 3:
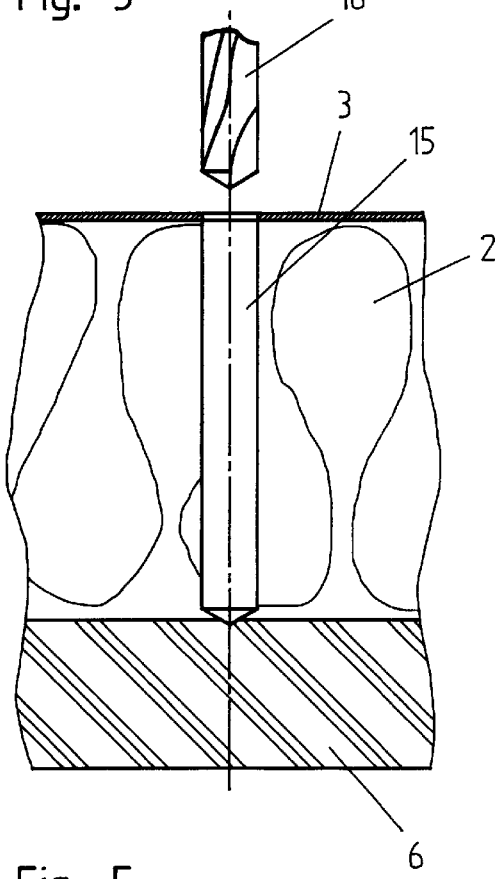
FIG. 3 to FIG. 8, the consecutive individual method steps for producing attachment using a fastening element in accordance with the invention.

FIG. 3 shows the first step. In order to prevent the hole 15 in roofing structures with bituminous coatings from adhering to the bore dust and optional silicium, a spiral drill 16 is employed, with the drilling preferably taking place without percussive effects. The hole 15 is made so deep that the free end of the drill stops at the substructure 6.

Figure 4:
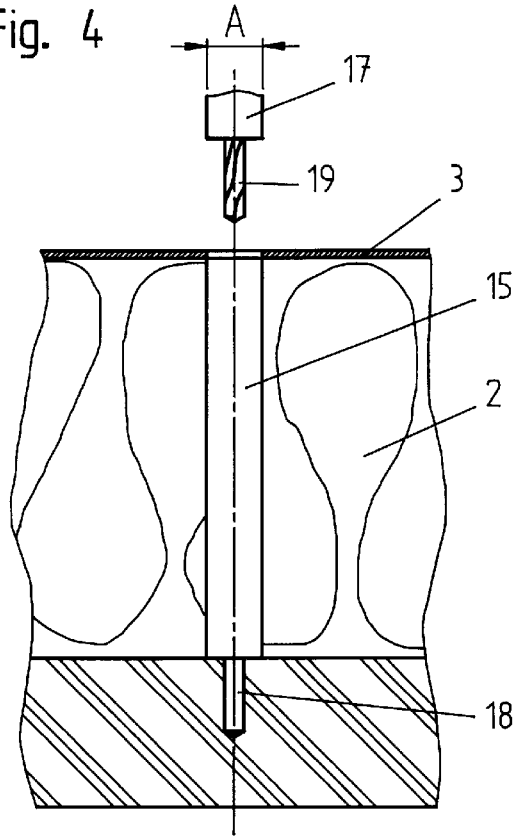
Figure 5:
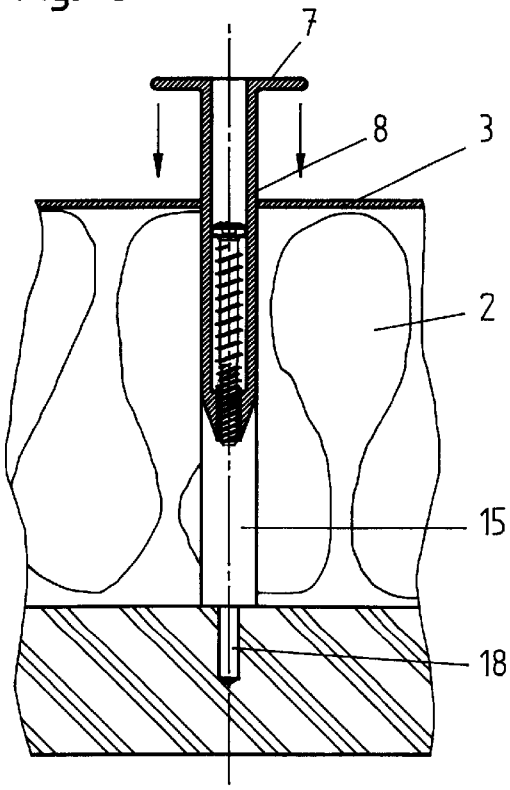
Figure 6:
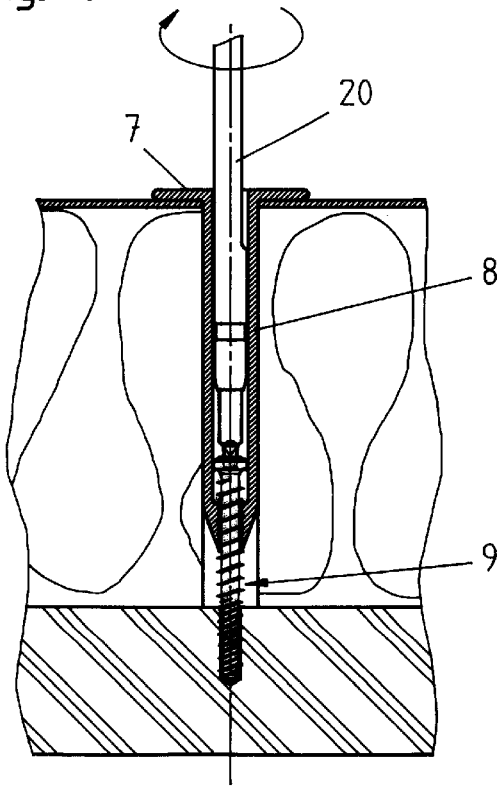

FIG. 4 shows how the hole 18 in substructure 6 is made with a special drill rod 17. An optimum hole exists when the drill 19 no longer produces a substantial advance or when a change in the sound of the percussion drill 19 is noticeable. The larger diameter A of the drill rod comes to rest against and therefore abuts against the top surface of the substructure 6. The large-area washer with its tubular extension and the screw, can then be inserted into the prepared hole 15 (FIG. 5).

The screw is driven in by means of a screwing element 20 connected to a torque-limited screwdriver which engages an engagement recess in head 10 of screw 9. The driving-in continues far enough that the thread section 14 in FIG. 1 penetrates completely into substructure 6, i.e. the screw 9 is seated at the lower end of hole 18. By means of preliminary pulling-out attempts, it can be determined how great the torque is which is necessary to timely shut off the torque-limited screwdriver.

In this manner, the fastening element 1 is properly seated and a large-area washer normally bears firmly against the upper-most side of the complete structure to be fastened. As can be seen, particularly in FIGS. 7 and 8, it can still happen that the large-area washer 7 does not rest properly on the upper-most sealing strip 3, i.e. pre-tensioning against the top-most cover of the whole structure is either not achieved, or it is too slight. Therefore, there exists the additional advantage of the present invention, namely using rotation of the large-area washer 7 with its tubular extension 8 to draw extension 8 inwardly in the axial direction by virtue of the threaded engagement with screw 9, the rotating movement being performed long enough that sufficient pre-tensioning occurs, and thereby causing bearing of the large-area washer 7 against sealing strip 3.

Figure 7:
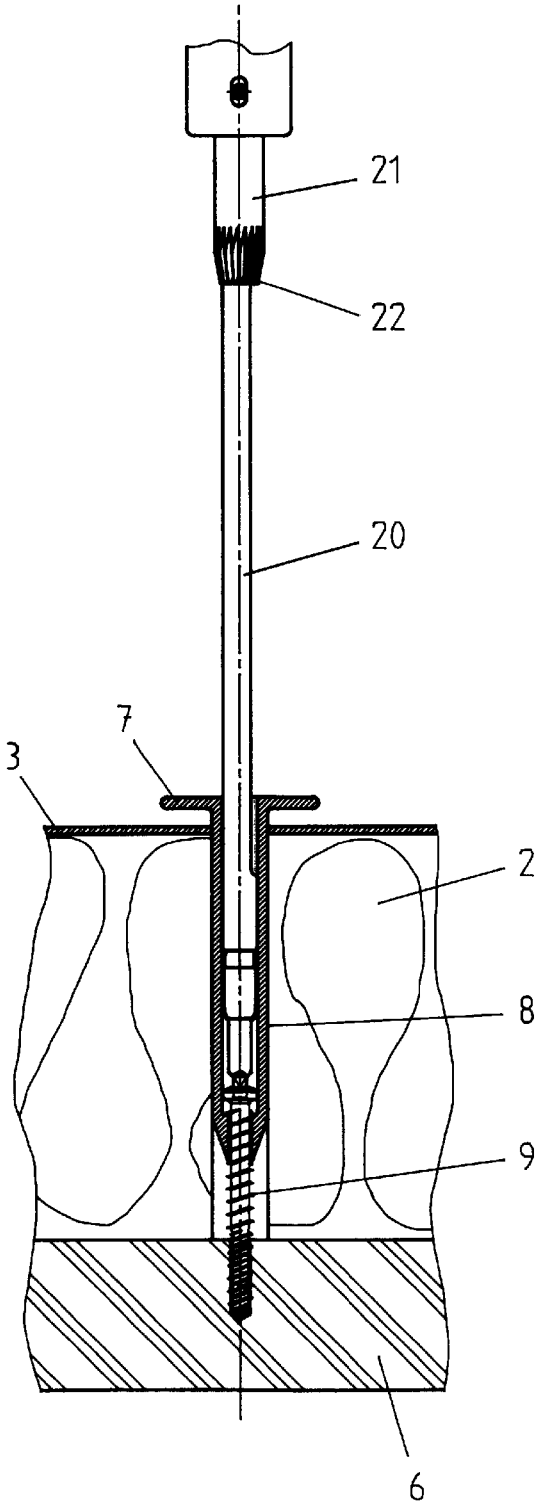
Figure 8:
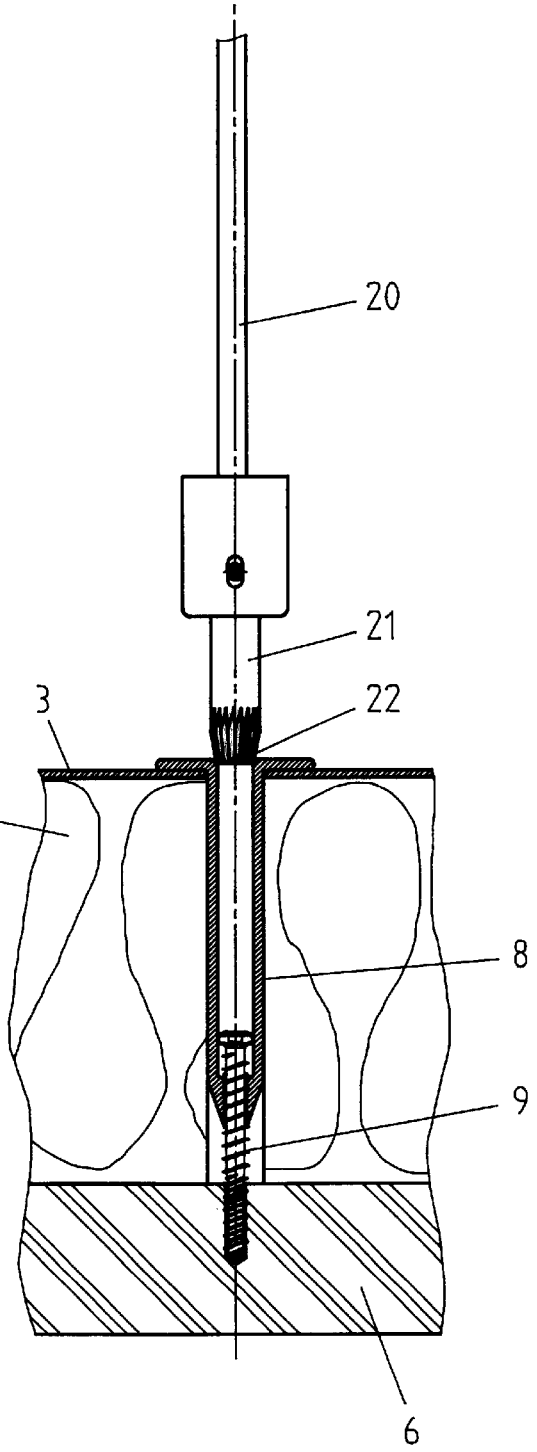

FIG. 7 shows the situation after the final setting of screw 9. Here it is proposed to form on screwing element 20, a special projection 21 which can, for example—as shown in FIG. 8—be pushed forward into an inserted position. Special projection 21 has an added piece 22 which is generally conical and is provided with ribs. In this embodiment, the projection 21 can be inserted a short distance into the outward end region of the tubular extension 8, so that co-rotation results. Final setting of the fastening element takes place by downward movement of tubular extension 8 along thread section 13, so that the screw itself is led farther into the interior of tubular extension 8.

It is also quite possible to equip the upper end of the tubular extension 8 facing large-area washer 7 with a kind of attaching point or some form of tool attachment. However, if the tubular extension is made of plastic, contact with special projection 21 is sufficient to provide the friction needed for co-rotation.

In the fastening element according to the invention, the large-area washer and tubular extension are preferably made in one piece from a plastic material. However, the washer and the tubular extension can also be made from other materials. Thus, it is possible to use a large-area washer 7 of metal into which there is then inserted a kind of tubular extension having an appropriate collar or with some axially operative connection for mutual fixation of washer and tubular extension. Screw 9 can also be made from various materials, including stainless materials. For attachment to a substructure consisting, for example, of metal or foam concrete, screw 9 can also be provided with a self-boring or self-piercing point.

The essential feature of the invention, namely that the tubular extension and the screw 9 are in mutually threaded engagement, can be achieved with different configurations of the screw, of the tubular extension and of the large-area washer.

What is claimed is:

1. Attaching element for attaching insulating strips or plates and possibly additional sealing strips to a fixed substructure, consisting of a screw, which is provided with a thread over at least a portion of the length of its shaft and which has a screw head, and a large-area washer with a tubular extension, in which the extension of the washer has an internal cross-section at least over a large portion of its length sufficient for the rotatable reception and for the axial displacement of the screw head, and which is narrowed at its end region remote from the washer for passage of the screw shaft, characterized in that the outer diameter (DA) of the shaft (11) of a screw (9) provided with a thread is greater than the free pass-through opening of the narrowed region (12) of the tubular extension (8), so that the screw (9) and the tubular extension (8) in its narrowed region (12) are in operative connection by means of mutual threaded engagement, or can be brought into such operative connection by rotation of the screw (9) into the pass-through opening.

2. Attaching element according to claim 1, characterized in that the screw (9) is provided with a thread over at least a large portion of the length of its shaft (11).

3. Attaching element according to claim 1, characterized in that the screw (9) is provided with a thread over the entire length of its shaft (11).

4. Attaching element according to 1, characterized in that on shaft (11) two differently configured thread sections (13, 14) of the screw (9) are provided.

5. Attaching element according to claim 4, characterized in that the two thread sections (13, 14) on shaft (11) of screw (9) have different diameters but equal thread pitch.

6. Attaching element according to claim 5, characterized in that, for two thread sections (13, 14) of different diameters, the pass-through opening at the narrowed region (12) of the tubular extension (8) is approximately equal to the outer diameter of section (14) of shaft (11) having the smaller diameter thread.

7. Attaching element according to one of claim 1, characterized in that the pass-through opening in the narrowed region (12) of tubular extension (8) is cylindrically shaped.

8. Attaching element for attaching insulating strips or plates and possibly additional sealing strips to a fixed substructure, consisting of a screw, which is provided with a thread over at least a portion of the length of its shaft and which has a screw head, and a large-area washer with a tubular extension, in which the extension of the washer has an internal cross-section at least over a large portion of its length sufficient for the rotatable reception and for the axial displacement of the screw head, and which is narrowed at its end region remote from the washer for passage of the screw shaft, characterized in that the outer diameter (DA) of the shaft (11) of a screw (9) provided with a thread is greater than the free pass-through opening of the narrowed region (12) of the tubular extension (8), so that the screw (9) and the tubular extension (8) in its narrowed region (12) are in operative connection by means of mutual threaded engagement, or can be brought into such operative connection by rotation of the screw (9) into the pass-through opening, in that on shaft (11) two differently configured thread sections (13, 14) of the screw (9) are provided, in that the two thread sections (13, 14) on shaft (11) of screw (9) have different diameters but equal thread pitch, and in that the thread section (14) having the smaller diameter at the free end region of shaft (11) of screw (9) is double threaded.

9. Attaching element according to claim 8, characterized in that the threads of the double threaded section (14) have different outer diameters.

10. Attaching element for attaching insulating strips or plates and possibly additional sealing strips to a fixed substructure, consisting of a screw, which is provided with a thread over at least a portion of the length of its shaft and which has a screw head, and a large-area washer with a tubular extension, in which the extension of the washer has an internal cross-section at least over a large portion of its length sufficient for the rotatable reception and for the axial displacement of the screw head, and which is narrowed at its end region remote from the washer for passage of the screw shaft, characterized in that the outer diameter (DA) of the shaft (11) of a screw (9) provided with a thread is greater than the free pass-through opening of the narrowed region (12) of the tubular extension (8), so that the screw (9) and the tubular extension (8) in its narrowed region (12) are in operative connection by means of mutual threaded engagement, or can be brought into such operative connection by rotation of the screw (9) into the pass-through opening, and in that the pass-through opening in narrowed region (12) of tubular extension (8) has cross-section adapted for such connection.

11. The method of attaching insulating strips or plates and possibly additional sealing strips or bituminous underlayers to a fixed substructure of thin concrete by means of a fastening element consisting of a screw and a large-area washer having a tubular extension according to claim 1, characterized in that there is initially provided, in the structure consisting of insulating strips (2) or plates, sealing strips (3) and possibly additional layers (4, 5), a hole which is substantially equal to the outer diameter of the tubular extension (8), then producing, in the concrete substructure (6), a hole (18) which fits the thread of screw (9) or possibly a plug for insertion of screw (9), after which washer (7) with tubular extension (8) and screw (9) are inserted and screw (9) is driven-in to its intended penetration depth, whereby the screw forms an engaging thread in the narrowed end region (12) of extension (8), or else engages a thread preformed therein, and finally, if a stronger drawing-together force of washer (7) against the upper-most sealing strip (3) is needed, washer (7) together with tubular extension (8) which is in operative connection with the thread of screw (9) is rotated relative to screw (9).

12. The method of claim 11, characterized in that the upper-most edge of the opening formed in washer (7) by tubular extension (8) can be brought into operative engagement by means of a driving tool.

* * * * *